US005927713A

United States Patent [19]

Driscoll et al.

[11] Patent Number: 5,927,713

[45] Date of Patent: Jul. 27, 1999

[54] APPARATUS AND METHOD FOR INVERTING, STAGING AND DIVERTING SHEET ARTICLES

[75] Inventors: James N. Driscoll, Perkasie; David M. Skvoretz, Northampton; James R. Moser; Donald Dudash, both of Easton, all of Pa.

[73] Assignee: Bell & Howell Mail Processing Systems, Durham, N.C.

[21] Appl. No.: 08/932,659

[22] Filed: Sep. 18, 1997

[51] Int. Cl.[6] ..... B65H 39/10

[52] U.S. Cl. ..... 271/298; 271/185

[58] Field of Search ..... 271/185, 186, 271/187, 298, 302, 303

[56] References Cited

U.S. PATENT DOCUMENTS 4,986,529 1/1991 Agarwal et al. ..... 271/186 X 5,603,494 2/1997 Baker et al. ..... 271/303 X 5,732,623 3/1998 Compera et al. ..... 271/187 X 5,794,931 8/1998 Heilman et al. ..... 271/303

*Primary Examiner*—William E. Terrell

*Assistant Examiner*—Gene O. Crawford

*Attorney, Agent, or Firm*—Jenkins & Wilson, P.A.

[57] ABSTRACT

A sheet processing apparatus and method for selectively inverting, staging and selectively advancing or diverting sheet material along a predetermined conveying path. The apparatus has a pair of support plates with space between the plates for passage of sheet material and a nip roller mechanism operatively connected to the support plates for advancing the sheet material. A rotation mechanism selectively simultaneously rotates the support plates as sheet material is positioned between the plates. The rotation mechanism selectively inverts the sheet material and positions the sheet material for advancement by the nip rollers from between the support plates along the predetermined conveying path.

20 Claims, 5 Drawing Sheets

APPARATUS AND METHOD FOR INVERTING, STAGING AND DIVERTING SHEET ARTICLES

TECHNICAL FIELD

The present invention relates generally to apparatuses and methods for inverting, staging and diverting sheet material. More particularly, the present invention relates to an apparatus and method for selectively inverting and staging sheet material and selectively advancing or diverting sheet material along a predetermined conveying path.

BACKGROUND ART

It is common in the art of sheet material processing to collate sheet material, such as paper sheets, inserts, envelopes and the like, and insert the sheet material into a mailing envelope in such a manner as to present the mailing address on the sheet material in the window of the mailing envelope. Although sheet material inserted into mailing envelopes can be unfolded, a folding system is frequently utilized to fold the sheet material into a half, triple or quarter folded form which is delivered or advanced to a raceway for conveying the folded sheet material to an envelope inserting machine.

Various apparatuses exist in the prior art for advancing folded sheet material to a machine raceway. To date, apparatuses for advancing folded sheet material to the machine raceway have typically had to be mounted on the front or rear of the machine raceway depending upon the address position and the type of fold.

Despite the existence of prior art apparatuses for advancing sheet material to an envelope inserting machine raceway, there remains much room for improvement in the art, particularly for an apparatus and method for selectively inverting, staging and selectively advancing or diverting sheet material prior to delivery of the sheet material to an envelope inserting machine raceway.

SUMMARY OF THE INVENTION

It is therefore an object of the present invention to provide a novel apparatus and method for selectively inverting, staging and selectively advancing or diverting sheet material.

It is another object of the present invention to provide an apparatus and method for selectively inverting, staging and selectively advancing or diverting sheet material wherein sheet material can be selectively inverted and/or staged and selectively advanced along a predetermined conveying path.

It is a further object of the present invention to provide an apparatus and method for selectively inverting, staging and selectively advancing or diverting sheet material wherein the apparatus and method are particularly suitable for delivering folded sheet material into an envelope inserting machine raceway so that addresses on the sheet material are face down and will therefore appear in the windows of envelopes after the folded sheet material is inserted into the envelopes by an envelope inserting machine.

It is still a further object of the present invention to provide an apparatus and method for selectively inverting, staging and selectively advancing or diverting sheet material wherein the apparatus can be placed at any suitable location along an envelope inserting machine raceway without the restriction of having to being mounted to the front or rear of the envelope inserting machine raceway.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
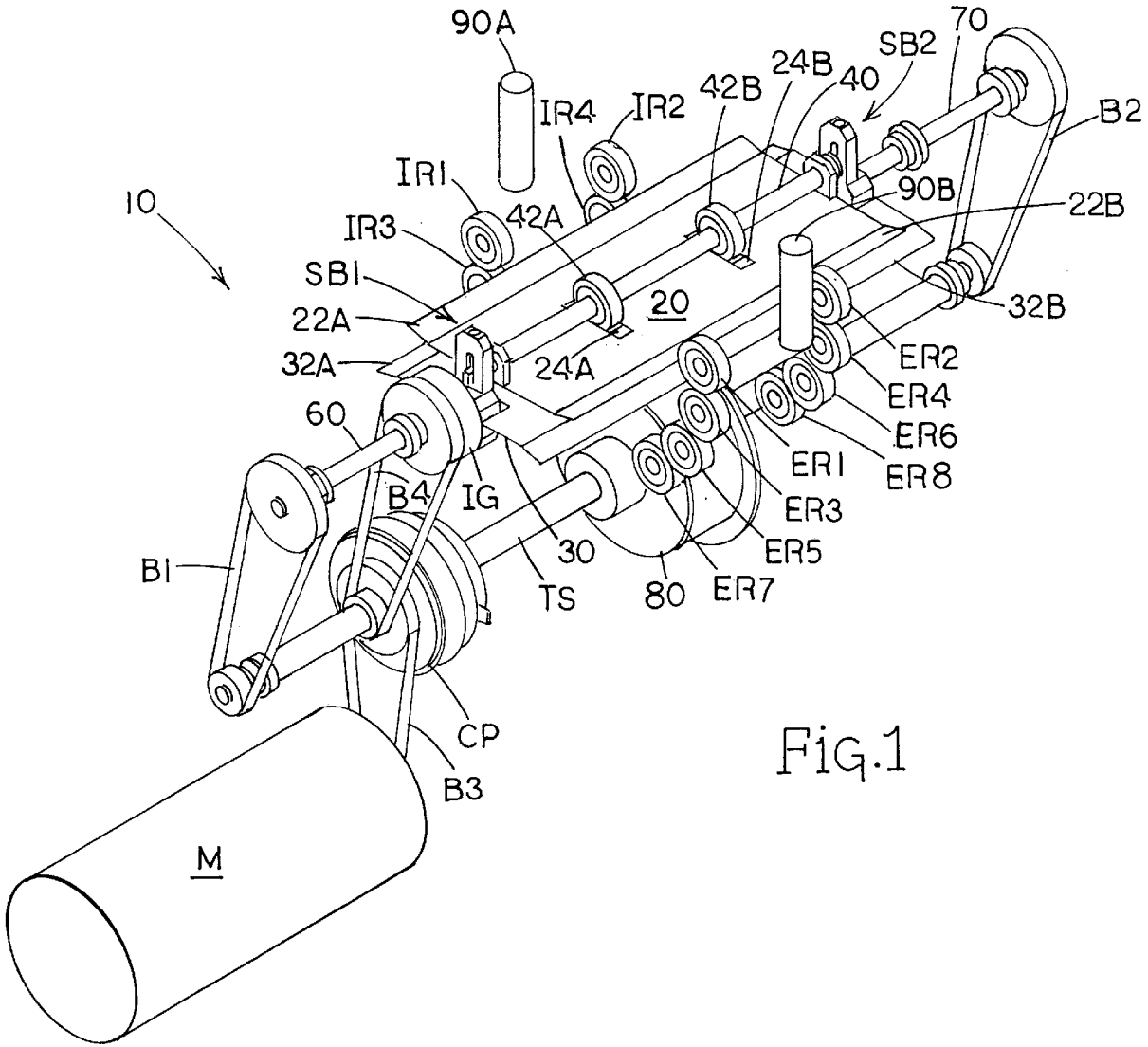
FIG. 1 of the drawings is a perspective view of a preferred embodiment of the sheet processing apparatus according to the present invention.

In accordance with the present invention, a sheet processing apparatus method 10 is provided for selectively inverting, staging and/or selectively advancing or diverting sheet material, such as single or stacked, folded or unfolded paper sheets for insertion into an envelope, along a selected one of a plurality of predetermined conveying paths. Referring to FIG. 1 of the drawings wherein a perspective view of a preferred embodiment of sheet processing apparatus 10 is shown, sheet processing apparatus 10 comprises a pair of support plates 20 and 30 adapted for advancement of sheets therebetween. Each support plate 20 and 30 includes slightly bent flange portions 22A 22B and 32A, 32B, respectively, on opposing ends thereof to assist sheets in passing between support plates 20 and 30. Support plates 20 and 30 additionally include slots 24A, 24B and 34A, 34B (not shown), respectively, defined therethrough in order for nip rollers to extend through the slots of both support plates 20 and 30 to engage sheets positioned therebetween, as further discussed hereinbelow. While it is envisioned that any suitable material could be used for construction of support plates 20 and 30, it is preferred that support plates 20 and 30 be formed of metal. As can be appreciated by those of skill in the art, support plates 20 and 30 can be of a variety of sizes adapted for processing of sheet material therebetween as described hereinbelow.

Figure 3:
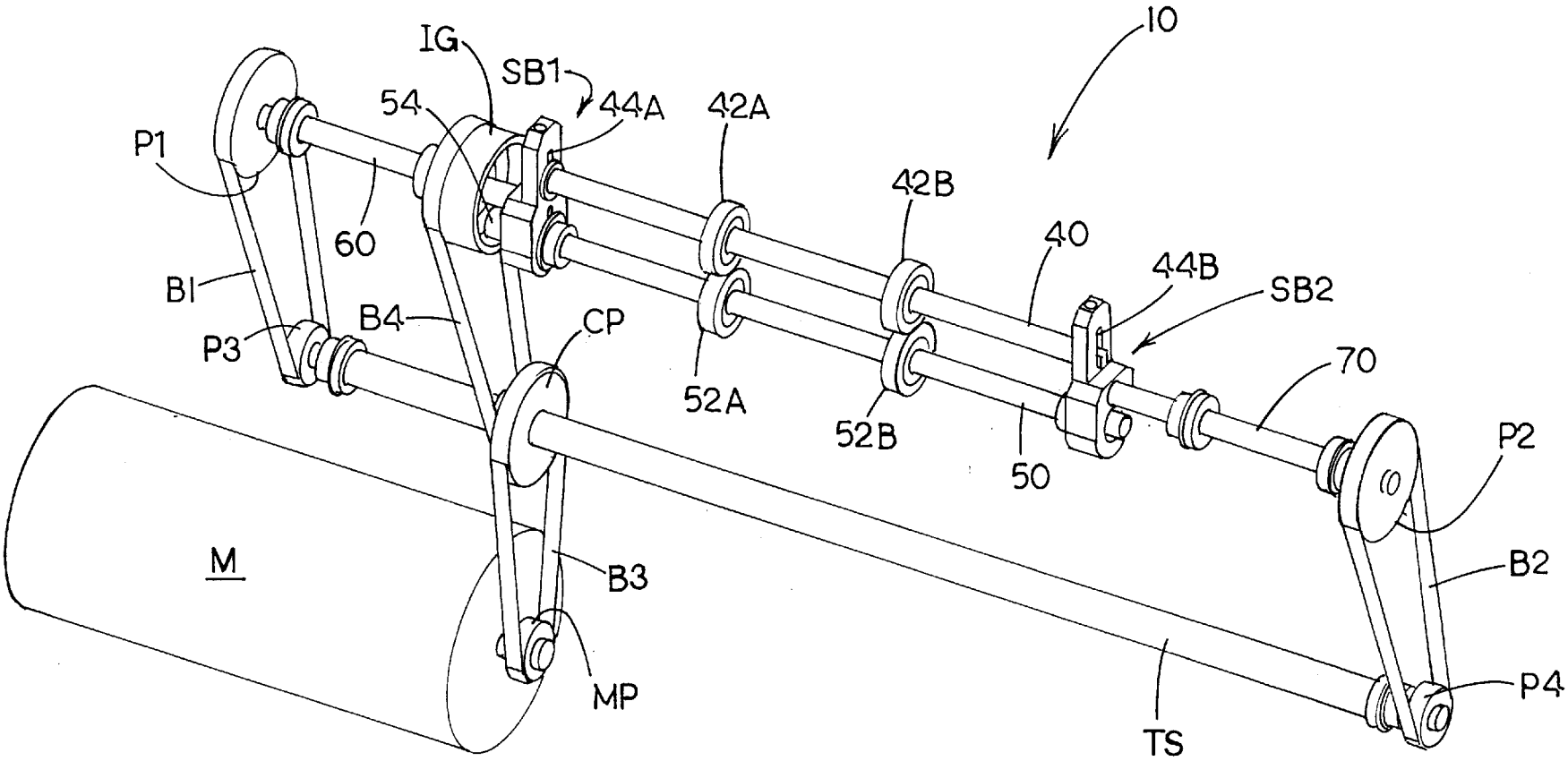
FIG. 3 of the drawings is a perspective view of a portion of the sheet processing apparatus of FIG. 1 with the support plates, brake, sensors, and inlet and exit rollers removed.

As best illustrated in FIG. 3 of the drawings, the nip rollers alluded to above which are adapted for extending through the slots of support plates 20 and 30 are nip rollers 42A and 42B which are positioned on inner shaft 40 and nip rollers 52A and 52B positioned on inner shaft 50. The nip rollers are located on inner shafts 40 and 50 as shown such that nip rollers 42A and 52A are adapted for suitable pressured engagement against one another with a sheet positioned therebetween as are nip rollers 42B and 52B. In the preferred embodiment, nip rollers 42A and 42B on inner shaft 40 are idler rollers which are freely rotatable about inner shaft 40. In the alternative, nip rollers 42A and 42B can be fixedly attached to inner shaft 40, and inner shaft 40 can itself be freely rotatable about its center longitudinal axis.

Both inner shafts 40 and 50 extend in a parallel relationship between side brackets generally designated SB1 and SB2 which are located at opposite ends of inner shafts 40 and 50. Inner shaft 40 is selectively moveable toward or away from inner shaft 50 by the connection of inner shaft 40 to side brackets SB1 and SB2 by extension of at least opposing portions of inner shaft 40 through slots 44A and 44B defined through side brackets SB1 and SB2, respectively, such that such portions of inner shaft 40 are selectively moveable within slots 44A and 44B.

Inner shaft 50 also extends and is maintained between side brackets SB1 and SB2. In the preferred embodiment, nip rollers 52A and 52B are fixedly attached to inner shaft 50, and inner shaft 50 is freely rotatable about its center, longitudinal axis between side brackets SB1 and SB2. A pinion 54 is operatively connected to inner shaft 50 through side bracket SB1 such that rotation of pinion 54 causes identical and simultaneous rotation of inner shaft 50. It is envisioned that pinion 54 can be integral with inner shaft 50 or simply attached thereto. As discussed hereinbelow, nip rollers 52A and 52B can therefore be drive rollers which can be used to drive sheets from between nip rollers 42A, 42B and 52A, 52B, respectively, and support plates 20 and 30 by operative rotation of inner shaft 50 through rotation of pinion 54.

Side brackets SB1 and SB2 are positioned between a pair of outer shafts 60 and 70 which are operatively connected to side brackets SB1 and SB2, respectively, on sides thereof opposite to inner shafts 40 and 50. Outer shafts 60 and 70 are preferably aligned such that the center, longitudinal axes of outer shafts 60 and 70 are colinear. Outer shafts 60 and 70 are preferably fixedly attached to side brackets SB1 and SB2 such that rotation of either or both of outer shaft 60 and/or outer shaft 70 cause simultaneous, corresponding rotation of side brackets SB1 and SB2 and therefore also of inner shafts 40 and 50 in view of the attachment of inner shafts 40 and 50 to and extension between side brackets SB1 and SB2 as described hereinabove.

Figure 2:
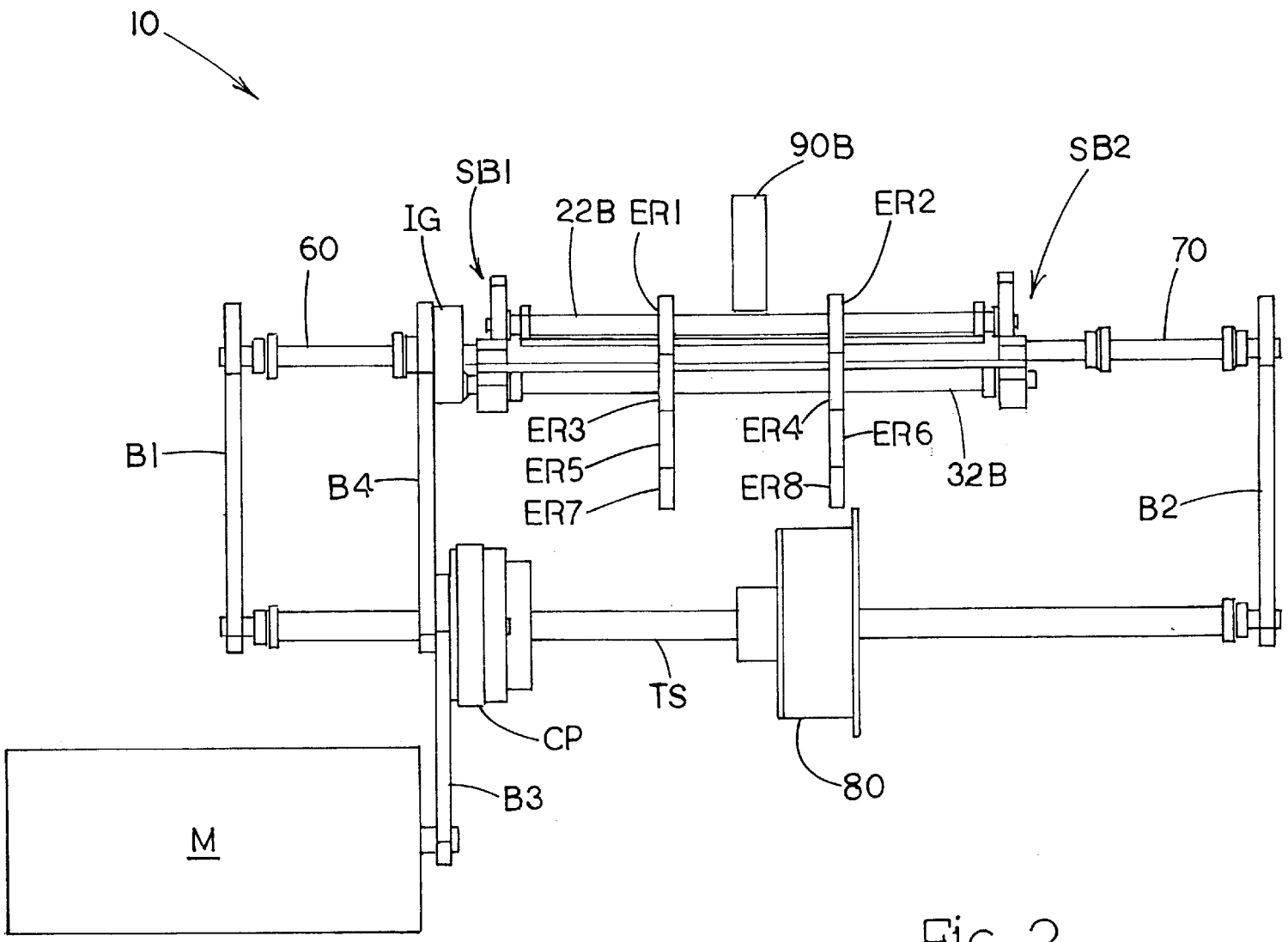
FIG. 2 of the drawings is a front elevational view of the sheet processing apparatus of FIG. 1.

Outer shafts 60 and 70 include pulleys P1 and P2, respectively, fixedly attached thereto. Sheet processing apparatus 10 includes a transmission shaft TS, also known as a jack shaft, as best shown in FIGS. 1, 2, and 3. Transmission shaft TS includes pulleys P3 and P4 for operative connection to belts B1 and B2 which also extend around pulleys P1 and P2 of outer shafts 60 and 70, respectively. By this structure, rotation of transmission shaft TS about its center, longitudinal axis thereby simultaneously rotates belts B1 and B2 as well as pulleys P1 and P2 in order to correspondingly rotate side brackets SB1 and SB2 with inner shafts 40 and 50 therebetween. Rotation of transmission shaft TS can be accomplished by servomotor M which can rotate its operatively connected motor pulley MP as belt B3 extends around and is driven by motor pulley MP and also extends around and causes rotation of clutch pulley CP which is attached to transmission shaft TS. Clutch pulley CP can be in an engaged position where clutch pulley CP is maintained fixedly attached to transmission shaft TS such that rotation of clutch pulley CP causes simultaneous rotation of transmission shaft TS. Clutch pulley CP can also be in an unengaged position where clutch pulley CP is free to rotate about transmission shaft TS without causing any rotation of transmission shaft TS.

Clutch pulley CP also has a belt B4 operatively extended around a portion thereof and which also operatively extends around a portion of internal gear IG which is preferably fixedly attached to outer shaft 60 as shown in FIGS. 1, 2, and 3 of the drawings. Internal gear IG is positioned on outer shaft 60 proximate side bracket SB1 wherein the inner surface of internal gear IG engages pinion 54, as shown in FIG. 3, such that rotation of internal gear IG causes simultaneous rotation of pinion 54 and therefore inner shaft 50 and nip rollers 52A and 52B thereon.

As shown in FIGS. 1 and 2 of the drawings, a brake 80 is attached to transmission shaft TS. When on, brake 80 prevents transmission shaft TS from rotating in either direction. When off, brake 80 permits rotation of transmission shaft TS in either direction. Both brake 80 and clutch pulley CP can be of any suitable and conventional type known to those in skill of the art of sheet processing.

By the structure of sheet processing apparatus 10 as described herein, sheet processing apparatus 10 can thereby be utilized for processing sheets wherein the sheets can be selectively inverted and/or staged between support plates 20 and 30 and selectively advanced from between support plates 20 and 30 along a predetermined conveying path which can be a divert path. To assist sheet apparatus 10 in such sheet processing, sheet apparatus 10 can further comprise a plurality of rollers strategically positioned for use in directing sheet material between support plates 20 and 30 as well as directing sheet material exiting from between support plates 20 and 30. As shown in FIG. 1 and partially shown in FIG. 2 of the drawings, such rollers can comprise inlet rollers IR1, IR2, IR3 and IR4, wherein inlet rollers IR1 and IR2 are upper rollers adapted for operative engagement with lower inlet rollers IR3 and IR4, respectively. Such rollers can also comprise exit rollers for directing sheets along a predetermined conveying path upon exiting from between support plates 20 and 30. As shown in FIGS. 1 and 2, such exit rollers can comprise exit rollers ER1, ER2, ER3 and ER4 for directing sheets in an advance direction for further processing. Exit rollers ER1 and ER2 are upper exit rollers adapted for operative engagement during sheet processing with lower exit rollers ER3 and ER4, respectively. Exit rollers ER5, ER6, ER7 and ERB can be provided for advancing sheets in a divert direction upon exiting from between support plates 20 and 30. Exit rollers ER5 and ER6 are upper exit rollers adapted for operative engagement during sheet processing with lower exit rollers ER7 and ER8.

As illustrated in FIGS. 1, 2, 4A and 4B, sheet processing apparatus 10 can also comprise electrical sensors for sensing the presence of sheet material during processing wherein the sensors can be connected to conventional computer means for operation thereof. Specifically, sheet processing apparatus 10 as shown comprises inlet sensor 90A and exit sensor 90B wherein inlet sensor 90A is positioned so as to sense the presence of sheet material about to enter between support plates 20 and 30 between inlet rollers IR1–IR4. Similarly, exit sensor 90B is positioned so as to be able to detect the presence of sheet material exiting sheet processing apparatus 10 from between support plates 20 and 30 and exit rollers ER1–ER4 and a separate, similar or identical sensor (not shown) could be used to detect the presence of sheet material passing through exit rollers ER5–ER8.

SHEET PROCESSING METHOD OF THE PRESENT INVENTION

Figure 4A:
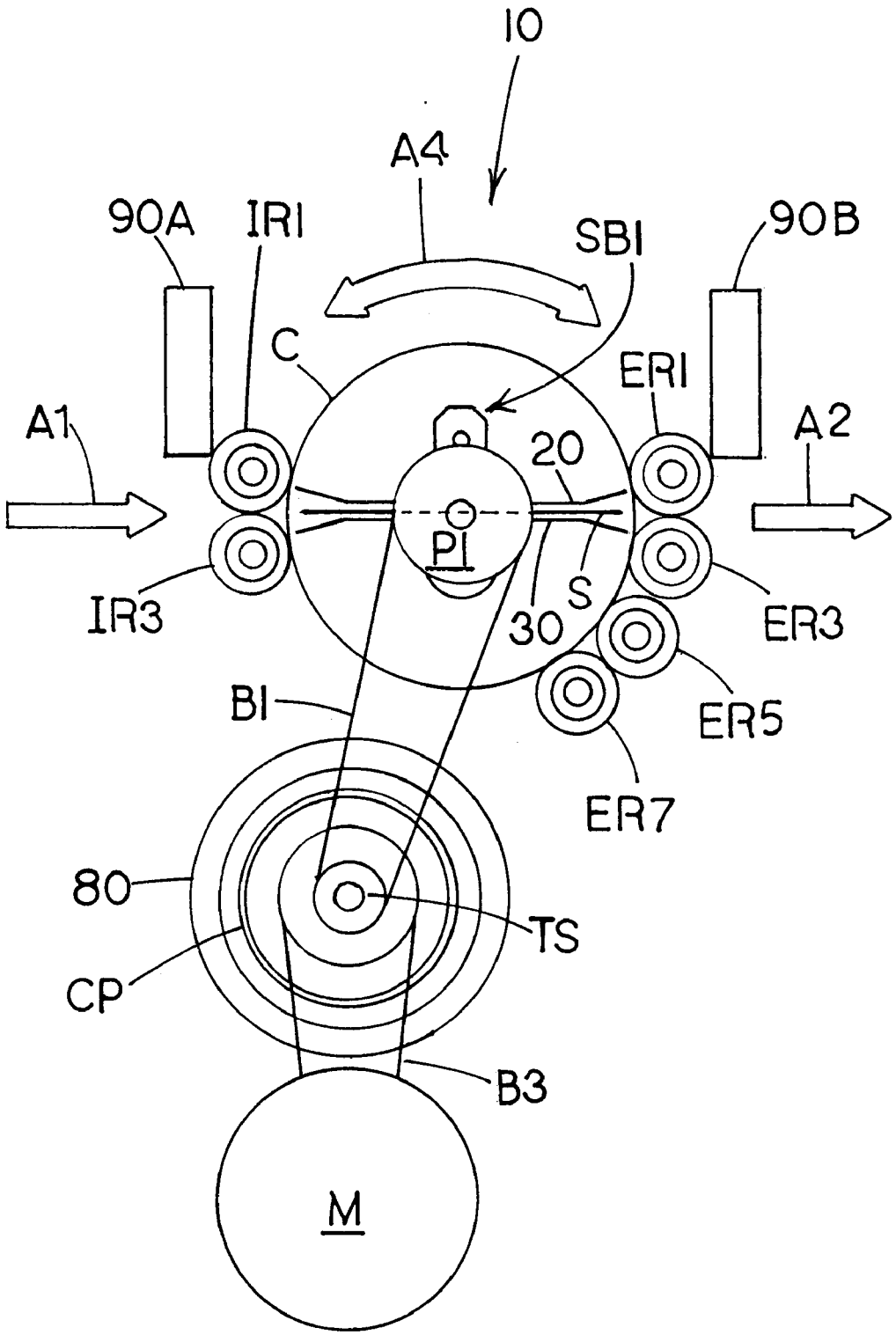
FIG. 4A of the drawings is a side elevational view of the sheet processing apparatus of FIG. 1 wherein the support plates are in a position adapted for advancing sheet material along a first conveying path between the exit rollers downstream of the support plates.

In accordance with the method of the present invention and referring initially to FIG. 4A, sheet material enters sheet processing apparatus 10 from an upstream device such as, for example, a folder, in the direction of arrow A1 where the presence of sheet material can be detected by inlet sensor 90A which can be electronically controlled to automatically initiate appropriate rotation of inlet rollers IR1–IR4 to advance the sheet material therebetween and to and between support plates 20 and 30 between nip rollers 42A, 52A, and 42B, 52B in a position such as sheet S in FIG. 4A. For purposes of describing the processing method of the present invention, support plates 20 and 30, inner shafts 40 and 50, nip rollers 42A, B, and 52A, B, and side brackets SB1 and SB2 can collectively be referred to as the nip roller system. The functioning of sheet processing apparatus 10 can be described by its three states of operation, each of which is described hereinbelow.

Operation State One

Figure 4B:
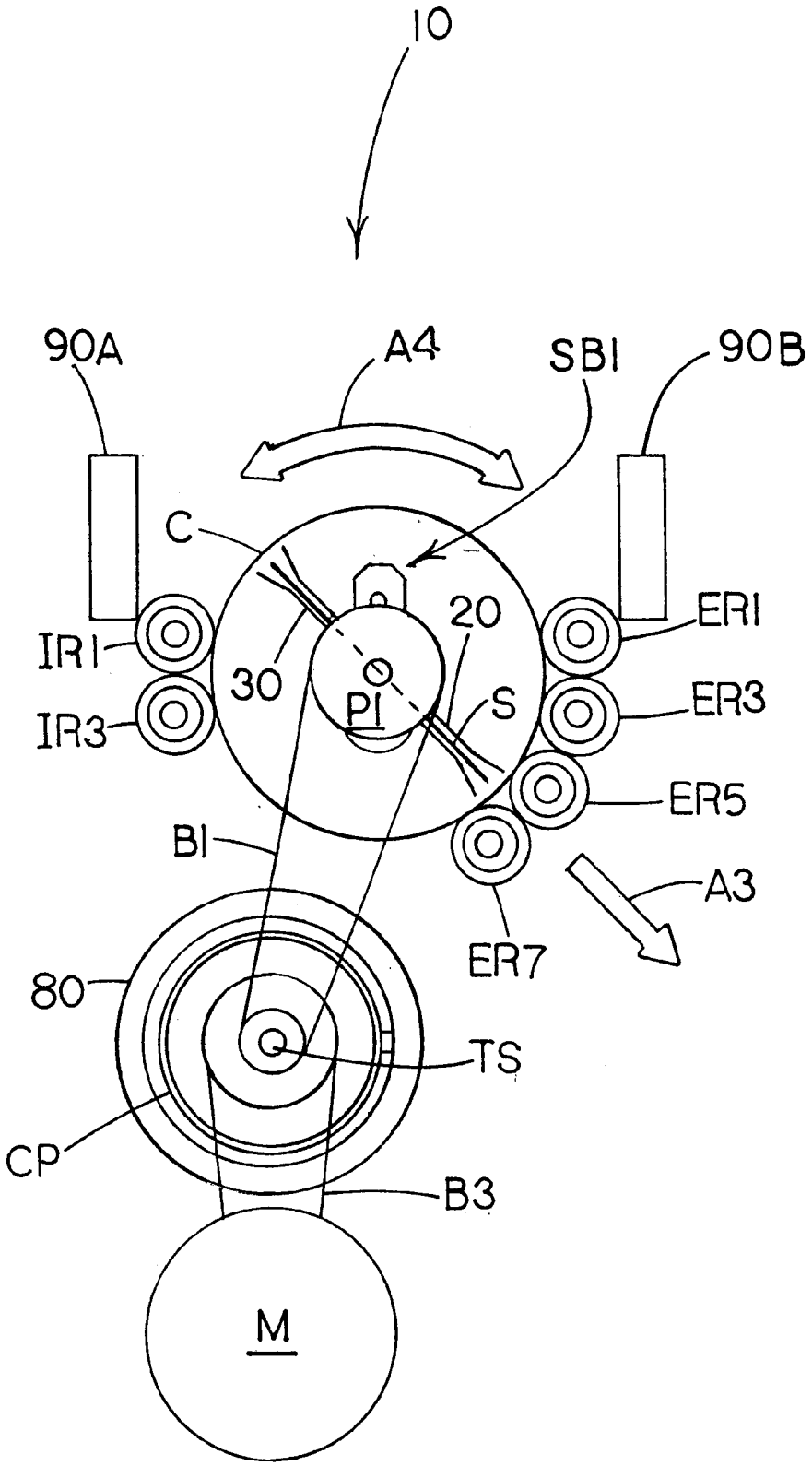
FIG. 4B of the drawings is a side elevational view of the sheet processing apparatus of FIG. 1 wherein the support plates are in a position adapted for advancing sheet material along a second conveying path between divert rollers downstream from the support plates.

Sheet processing apparatus 10 is at rest in this state of operation. Motor M is off and clutch pulley CP is unengaged while brake 80 on transmission shaft TS is on in order to prevent transmission shaft TS from rotating. Three distinct rest positions exist within this state of operation. In the first rest position, which can be described as the normal rest position for the nip roller system, support plates 20 and 30 are in a horizontal position as spring-loaded nip rollers 42A and 42B are facing upwardly as shown in FIG. 4A of the drawings. In the second rest position (not shown), which can be described as the invert rest position for the nip roller system, support plates 20 and 30 are in a horizontal position while spring-loaded nip rollers 42A and 42B are facing downwardly. Finally, in the third rest position, which can be described as the divert rest position for the nip roller system, support plates 20 and 30 are not in a horizontal position but, rather, are in a divert position aligned with and adapted for advancing sheet material between exit rollers ER5, ER7 and ER6, ER8, as illustrated in FIG. 4B of the drawings where sheet S is maintained in the nip roller system in a divert position.

Operation State Two

In this state of operation of sheet processing apparatus 10, nip rollers 52A and 52B rotate. Motor M is on and its rotation direction can be function dependent in that the direction of rotation of driven nip rollers 52A and 52B is a function of orientation (rest position). In the normal rest position, driven nip rollers 52A and 52B are positioned beneath spring-loaded nip rollers 42A and 42B, and driven nip rollers 52A and 52B are positioned above spring-loaded nip rollers 42A and 42B in the inverted rest position. Simultaneous with operation of motor M, brake 80 is on and clutch pulley CP is unengaged. Brake 80 therefore prevents transmission shaft TS from rotating which prevents rotation of outer shafts 60 and 70 and therefore also of the overall nip roller system. Since clutch pulley CP is unengaged, clutch pulley CP is free to rotate about transmission shaft TS and this allows power transmission from motor M to internal gear IG by way of belts B3 and B1. Such rotation of internal gear IG causes rotation of pinion 54 to correspondingly rotate inner shaft 50 and therefore nip rollers 52A and 52B. In this manner, sheet material positioned between support plates 20 and 30, such as sheet S in FIGS. 4A and 4B, can be advanced from therebetween. The direction in which the sheet material can be advanced by nip rollers 52A and 52B can be in the advance direction as indicated by arrow A2 in FIG. 4A where sheet material, such as sheet S, will advance between exit rollers ER1, ER3 and ER2, ER4 where the presence of the exiting sheet material can be detected by exit sensor 90B. The direction in which nip rollers 52A and 52B advance sheet material from between support plates 20 and 30 can also be in the divert direction as indicated by arrow A3 in FIG. 4B where the sheet material, such as sheet S, can be advanced between exit rollers ER5, ER7 and ER6, ER8. The direction in which sheet material is advanced by nip rollers 52A and 52B from between support plates 20 and 30 is dependent upon the directional alignment of support plates 20 and 30 and determined by selected rotation of support plates 20 and 30.

Operation State Three

In this state of operation of sheet processing apparatus 10, the overall nip roller system including support plates 20 and 30 is rotated. Motor M is on as its rotation is again function dependent. Rotation of motor M is preferably counter-clockwise when the nip roller system rotates from a position for diverting to a position at least substantially horizontal, and rotation of the nip roller system is preferably clockwise for normal 180 degree rotation of the nip roller system. Simultaneous with rotation of motor M, clutch pulley CP is engaged and brake 80 is off to thereby allow transmission shaft TS to rotate. The engaged position of clutch pulley CP locks clutch pulley CP to transmission shaft TS. As such, motor M can drive clutch pulley together with transmission shaft TS. Belts B1 and B2 therefore simultaneously and identically rotate outer shafts 60 and 70 to rotate the overall nip roller system. In this manner, there is no relative rotation between internal gear IG and pinion 54, thus preventing nip rollers 52A and 52B from rotating. Any sheet material positioned between support plates 20 and 30 as well as nip rollers 42A, 52A and 42B, 52B therefore remains in such position as the overall nip roller system including support plates 20 and 30 is selectively rotated.

Since rotation of motor M is function dependent, the rotation of the overall nip roller system including support plates 20 and 30 can also be in either a clockwise or a counterclockwise direction as desired as indicated by arrow A4 in FIGS. 4A and 4B. It can therefore be understood by those of skill in the art that support plates 20 and 30 with sheet material positioned therebetween, such as sheet S in FIGS. 4A and 4B, can selectively be rotated 3600 about the arc of circle C shown in FIGS. 4A and 4B in order to invert the sheet material and/or selectively position sheet material therebetween for subsequent advancement in the advance direction of arrow A2 of FIG. 4A or in the divert direction of arrow A3 of FIG. 4B. As can also be readily understood by those of skill in the art of sheet processing, inversion of sheet material positioned between support plates 20 and 30 merely requires rotation of support plates 20 and 30 180° while diversion of sheet material processed through sheet processing apparatus 10 merely requires rotation of support plates 20 and 30 at least approximately 45° in order to align and position sheet material between support plates 20 and 30 for subsequent advancement in the divert direction of arrow A3 of FIG. 4B.

It can therefore be seen that a novel apparatus and method for selectively inverting, staging and selectively advancing or diverting sheet material is provided. According to the invention as described herein, sheet material can be selectively inverted and/or staged and selectively advanced along a predetermined conveying path. The apparatus and method described herein are particularly suitable for delivering folded sheet material into an envelope inserting machine raceway so that addresses on the sheet material are face down and will therefore appear in the windows of envelopes after the folded sheet material is inserted into the envelope by an envelope inserting machine. It can therefore be seen that the apparatus of this invention can be placed at any suitable location along an envelope inserting machine raceway without the restriction of having to be mounted to the front or rear of the envelope inserting machine raceway.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A sheet processing apparatus for selectively inverting, staging and selectively advancing or diverting sheet material along a selected one of a plurality of predetermined conveying paths, said sheet processing apparatus comprising:

(a) a pair of support plates defining a space therebetween adapted for advancement of sheet material therethrough;

(b) a nip roller mechanism in operative cooperation with said support plates for selectively staging in and advancing sheet material from the space between said support plates, said advance mechanism comprising at least a pair of cooperating nip rollers for engaging sheet material in said space between said support plates, said nip rollers being operatively positioned on shafts which are connected to said support plates such that rotation of said support plates simultaneously rotates said nip rollers and said shafts; and (c) a rotation mechanism for selectively simultaneously rotating said support plates and said nip roller mechanism at least partially about an arc of a circle for selectively inverting sheet material therebetween and positioning sheet material therebetween for advancement along a selected one of a plurality of predetermined conveying paths;

(d) whereby said sheet processing apparatus is selectively operative for:

(i) sheet material between said support plates to be selectively inverted by rotation of said support plates by said rotation mechanism;

(ii) sheet material between said support plates to be selectively positioned for advancement along a selected one of a plurality of predetermined conveying paths by rotation of said support plates by said mechanism; and (iii) sheet material between said support plates to be selectively staged and selectively advanced by said advance mechanism from between said support plates along a selected one of a plurality of predetermined conveying paths.

2. The sheet processing apparatus of claim 1 wherein said pair of nip rollers comprises an upper nip roller and a lower nip roller with said upper nip roller and a lower nip roller with said upper and lower nip rollers each extending through different openings defined in said support plates.

3. The sheet processing apparatus of claim 1 wherein said rotation mechanism comprises a motor operatively connected to and for driving a shaft to which at least one of said support plates is attached.

4. The sheet processing apparatus of claim 1 wherein said support plates are adjustably attached such that the space therebetween can be selectively adjusted to accommodate stacks of sheet material of different sizes.

5. The sheet processing apparatus of claim 1 further comprising inlet rollers and exit rollers positioned upstream and downstream, respectively, from said support plates for advancing sheet material between and from between, respectively, said support plates.

6. A sheet processing apparatus for selectively inverting, staging and selectively advancing sheet material along a selected predetermined conveying path, said sheet processing apparatus comprising:

(a) a pair of support plates defining a space therebetween for advancement of sheet material therethrough;

(b) at least one pair of cooperating nip rollers for operatively engaging sheet material in said space between said support plates, said nip rollers being positioned on first and second inner shafts which extend between opposing base members and at least one of said nip rollers being fixedly attached to said first inner shaft;

(c) a pinion extending from one of said base members and being connected to at least said first inner shaft such that rotation of said pinion simultaneously rotates said first inner shaft;

(d) opposing first and second outer shafts each operatively connected to a different one of said base members such that rotation of said first and second outer shafts simultaneously rotates said base members and said first and second inner shafts;

(e) a first gear member operatively attached on at least said first outer shaft and engaging said pinion such that rotation of said first gear member against said pinion to simultaneously rotate said pinion simultaneously rotate said nip roller on said first inner shaft; and (f) a rotation mechanism for selectively rotating said first and second outer shafts and said first gear member.

7. The sheet processing apparatus of claim 6 wherein said rotation mechanism comprises a rotatable transmission shaft which is operatively connected to said first and second outer shafts such that rotation of said transmission shaft simultaneously rotates said first and second outer shafts, said transmission shaft also being operatively connected to said first gear member by a selectively engageable clutch pulley such that rotation of said transmission shaft can selectively simultaneously rotate said first gear member.

8. The sheet processing apparatus of claim 7 further comprising a selectively engageable brake operatively attached to said transmission shaft.

9. The sheet processing apparatus of claim 7 wherein said rotation mechanism further comprises a motor operatively connected to and for driving said transmission shaft wherein said motor is operatively connected to said clutch pulley on said transmission shaft.

10. A method of selectively inverting, staging and/or selectively advancing sheet material along a predetermined path, said method comprising the steps of:

(a) advancing sheet material between a pair of support plates between at least a pair of nip rollers attached to separate nip roller shafts, said nip rollers and said nip roller shafts together defining a nip roller mechanism;

(b) selectively staging said sheet material between said support plates and said pair of nip rollers;

(c) selectively simultaneously rotating said support plates and said nip roller mechanism at least partially about an arc of a circle with said sheet material between said support plates to selectively position said sheet material for subsequent advancement along a predetermined conveying path; and (d) selectively advancing with rotation of at least one of said nip rollers said sheet material from between said support plates along a predetermined conveying path.

11. The method of claim 10 wherein said sheet material is also inverted by the step of paragraph (c).

12. The method of claim 10 wherein said sheet material is advanced from between said support plates along a predetermined conveying path which diverts said sheet material from an original conveying path along which said sheet material is advanced upstream from said support plates.

13. The method of claim 10 wherein said sheet material is advanced between said support plates by inlet rollers upstream from said support plates.

14. The method of claim 13 wherein said sheet material is advanced between and pulled by exit rollers positioned downstream from said support plates after said sheet material is advanced from between said support plates.

15. A method of selectively inverting, staging and/or selectively advancing sheet material along a predetermined path, said method comprising the steps of:

(a) advancing sheet material between a pair of support plates where said sheet material is maintained in position by at least one nip roller on a shaft with a central axis maintained at a vertical position;

(b) selectively simultaneously rotating said support plates with said sheet material therebetween at least partially about an arc of a circle while simultaneously rotating the vertical position of said shaft holding said nip roller to selectively position said sheet material for subsequent advancement along a predetermined conveying path; and (c) selectively actuating said at least one nip roller to advance said sheet material from between said support plates.

16. The method of claim 15 wherein said sheet material is inverted by the step of paragraph (b).

17. A sheet processing apparatus for selectively inverting, staging and selectively advancing sheet material along a selected predetermined conveying path, said sheet processing apparatus comprising:

(a) a pair of support plates defining a space therebetween for advancement of sheet material therethrough;

(b) at least one pair of cooperating nip rollers for operatively engaging sheet material in said space between said support plates, said nip rollers being positioned on first and second inner shafts which extend between opposing base members and at least one of said nip rollers being fixedly attached to said first inner shaft;

(c) a pinion extending from one of said base members and being connected to at least said first inner shaft such that rotation of said pinion simultaneously rotates said first inner shaft;

(d) at least one outer shaft operatively connected to one of said base members such that rotation of said outer shaft simultaneously rotates both base members and said first and second inner shafts;

(e) a first gear member operatively attached to said outer shaft and engaging said pinion such that rotation of said first gear member against said pinion to simultaneously rotate said pinion simultaneously rotates said nip roller on said first inner shaft; and (f) a rotation mechanism for operatively connecting with and for selectively rotating said outer shaft and said first gear member.

18. A method of selectively advancing sheet material along a selected predetermined conveying path, said method comprising the steps of:

(b) providing a sheet processing apparatus comprising:

(i) a pair of support plates defining a space therebetween for advancement of sheet material therethrough;

(ii) at least one pair of cooperating nip rollers for operatively engaging sheet material in said space between said support plates, said nip rollers being positioned on first and second inner shafts which extend between opposing base members and at least one of said nip rollers being fixedly attached to said first inner shaft;

(iii) a pinion extending from one of said base members and being connected to at least said first inner shaft such that rotation of said pinion simultaneously rotates said first inner shaft;

(iv) at least one outer shaft operatively connected to one of said base members such that rotation of said outer shaft simultaneously rotates both base members and said first and second inner shafts;

(v) a first gear member operatively attached to said outer shaft and engaging said pinion such that rotation of said first gear member against said pinion to simultaneously rotate said pinion simultaneously rotates said nip roller on said first inner shaft; and (vi) a rotation mechanism for selectively operatively connecting with and for selectively rotating said outer shaft and said first gear member;

(b) advancing sheet material between said support plates and said nip rollers wherein said nip rollers engage said sheet material;

(c) selectively simultaneously rotating said support plates a predetermined extent with said sheet material therebetween; and (d) actuating at least one of said nip rollers to selectively advance said sheet material from between said support plates along a predetermined conveying path.

19. The method of claim 18 wherein selectively simultaneously rotating said support plates with said sheet material therebetween a predetermined extent is accomplished by rotation of said rotation member and said outer shaft.

20. The method of claim 18 wherein actuating at least one of said nip rollers to selectively advance said sheet material from between said support plates along a predetermined conveying path is accomplished by rotation of said first gear and said pinion.

* * * * *